US010511130B2

(12) United States Patent
Huang

(10) Patent No.: US 10,511,130 B2
(45) Date of Patent: Dec. 17, 2019

(54) CHARGING CONNECTOR HAVING A SLEEVE WITH SLOTS SURROUNDING A CONTACT PIECE WITH CORRESPONDING CONTACT ARMS

(71) Applicant: Li-Ying Huang, Dongguan (CN)

(72) Inventor: Li-Ying Huang, Dongguan (CN)

(73) Assignee: Suyin Electronics (Dongguan) Co., Ltd, Dongguan, Guangdong (CN)

( * ) Notice: Subject to any disclaimer, the term of this patent is extended or adjusted under 35 U.S.C. 154(b) by 0 days.

(21) Appl. No.: 15/698,617

(22) Filed: Sep. 7, 2017

(65) Prior Publication Data

US 2019/0074650 A1 Mar. 7, 2019

(51) Int. Cl.

| | |
|---|---|
| ***H01R 13/187*** | (2006.01) |
| ***H01R 31/06*** | (2006.01) |
| ***H01R 13/11*** | (2006.01) |
| ***H01R 13/631*** | (2006.01) |
| ***H01R 13/52*** | (2006.01) |
| *H01R 13/05* | (2006.01) |

(52) U.S. Cl.

CPC ..... *H01R 31/06* (2013.01); *H01R 13/11* (2013.01); *H01R 13/111* (2013.01); *H01R 13/187* (2013.01); *H01R 13/5202* (2013.01); *H01R 13/631* (2013.01); *H01R 13/052* (2013.01); *H01R 13/521* (2013.01); *H01R 2201/26* (2013.01)

(58) Field of Classification Search

CPC ..... H01R 13/11; H01R 24/54; H01R 27/00; H01R 31/06; H01R 33/94; H01R 13/5202; H01R 13/631; H01R 13/052

USPC ..... 439/275, 300, 628, 638, 843, 851

See application file for complete search history.

(56) References Cited

U.S. PATENT DOCUMENTS

| | | | | |
|---|---|---|---|---|
| 5,664,972 | A * | 9/1997 | Zinn | H01R 13/113 439/839 |
| 6,126,495 | A * | 10/2000 | Lolic | H01R 13/18 439/752.5 |
| 8,939,784 | B2 * | 1/2015 | Lee | H01R 23/70 439/314 |
| 8,944,858 | B2 * | 2/2015 | Schmidt | H01R 4/06 439/754 |
| 9,236,682 | B2 * | 1/2016 | Glick | H01R 13/62 |
| 9,293,852 | B2 * | 3/2016 | Glick | H01R 43/20 |
| 9,437,974 | B2 * | 9/2016 | Glick | H01R 13/642 |
| 9,847,591 | B2 * | 12/2017 | Glick | H01R 13/18 |
| 2013/0171886 | A1 * | 7/2013 | Neumann-Henneberg | H01R 13/187 439/676 |

(Continued)

*Primary Examiner* — Hae Moon Hyeon

(57) ABSTRACT

A charging connector for electric vehicle having one-piece sleeve and contact piece connected to each other, comprising: a sleeve and a contact piece; wherein the contact piece is a one-piece structure and formed integrally with a plurality of contact arms, a connecting portion and a wiring portion, the connecting portion is cylindrical and the plurality of contact arms are extended forwardly from a periphery of one end of the connecting portion; wherein the sleeve is sleeved outside the contact arms and includes slots corresponding to each of the contact arms; the sleeve and the contact piece are connected by snaps; when used, conductive pins in an external receptacle are inserted along a port of the sleeve and inserted into the contact arms to form a conductive contact with the contact arms.

7 Claims, 5 Drawing Sheets

(56) References Cited

U.S. PATENT DOCUMENTS

2016/0028169 A1* 1/2016 Glick ..... H01R 13/18
439/816

* cited by examiner

CHARGING CONNECTOR HAVING A SLEEVE WITH SLOTS SURROUNDING A CONTACT PIECE WITH CORRESPONDING CONTACT ARMS

BACKGROUND OF INVENTION

1. Field of the Invention

The present invention relates generally to the technical field of charging equipments, and more particularly to a conductive adapter for charging gun.

2. Description of Related Art

With the development of electric vehicles, the demand for the electric vehicle charging gun grows increasingly. FIG. 1 shows a charging gun for rechargeable cars, which comprises a charging gun body 5. There is a plug 51 in the front of the body 5. Said plug 51 has a charging interface 52 which can be electrically connected to an external equipment to be charged. There are several conductive adapters 50 in the charging interface 52, each conductive adapter 50 has a conductive plug hole 501 for connecting the conductive contact pin (pole) in the device to be charged. As the working current of charging gun is very high, the conductive adapter 50 in the plug 51 is different from conventional plugs. The conductive adapters for the present charging gun are mostly turned metalwork, which is to say, a metal bar is shaped by turning, cutting and milling directly, and the conductive plug hole 501 is processed by milling cutter. In addition, in order to guarantee the stability of electric contact, there shall be an additional metal spring clamp 502 in the conductive plug hole 501. When tire conductive contact pin is plugged into the conductive plug hole 501, the metal spring clamp 502 and conductive contact pin form a tight electrical connection.

From the above mentioned, the present conductive adapter processing technique is complex, the processing cost is high, and the metal spring clamp 502 is put in the conductive plug hole 501 manually, reducing the production efficiency. Therefore, the present conductive adapter for charging gun cannot meet the market demand anymore, so this inventor proposes the following technical proposal.

BRIEF SUMMARY OF THE INVENTION

The technical problem to be solved by the present invention is to overcome the shortcomings of the prior art and to provide a conductive adapter for charging gun.

In order to solve the above technical problems, the present invention adopts die following technical scheme: a conductive adapter for charging gun, comprising: a sleeve and a contact piece; wherein the contact piece is formed integrally and includes a plurality of contact arms, a connecting portion and a wiring portion, said connecting portion being cylindrical and the plurality of contact arms extending forwardly from the connecting portion and enclosing a cylindrical structure; wherein the sleeve is disposed outside the cylindrical structure of the contact arms and includes hole slots corresponding to each of the contact arms; the sleeve and the contact piece are connected by snaps; when used, conductive pins in an external receptacle are inserted along a port of the sleeve and inserted into the cylindrical structure enclosed by the contact arms to form a conductive contact with the contact arms.

More preferably, wherein the connecting portion of the contact piece is integrally formed with a plastic holder, and the wiring portion is protruded from a rear end of the plastic seat.

More preferably, wherein the connecting portion is integrally formed with a front convex piece and a rear convex piece disposed on a circumferential surface thereof, the convex direction of the front convex piece is opposite to that of the rear; the sleeve includes a groove and a locking hole respectively corresponding to the front convex piece and the rear convex piece.

More preferably, wherein the contact arms extend forwardly from the connecting portion and front ends of the contact arm are turned outward so that the front ends of all the contact arms are formed as a bell mouth shape and bent inwardly at: a position close to the front ends of the contact arms to form bent bulges.

More preferably, wherein the shape of the slot on the sleeve is greater than that of the contact arm so that the contact arm can be deformed in the hole slot under internal extrusion.

More preferably, wherein the sleeve includes a plurality of guide convex positions uniformly disposed near an inner edge of a front end port.

More preferably, wherein the sleeve is formed as a bell mouth shape disposed at a rear end port thereof.

More preferably, wherein the connecting portion includes an air vent disposed thereon.

More preferably, wherein the wiring portion extending rearwardly from said connecting portion to form a cylindrical shape, and there is a gap in a junction of the wiring portion and connecting portion.

More preferably, wherein the side of the plastic holder near the sleeve is formed with a stepped section on which a waterproof ring is fitted.

The present invention has the following advantages as compared with the prior art: the structure of the present invention is simple and the sleeve and the contact piece can be directly press-formed, and the production cost of the present invention can be greatly improved compared with the conventional production method. Besides, the present invention can realize the automatic operation at the same time, and the production efficiency can be greatly improved. Compared with the existing products, the present invention has the advantages of low cost, good conductive stability and easy production and processing.

DETAILED DESCRIPTION OF THE INVENTION

Described with attached figures below.

As shown in FIGS. 3-6, the present invention is a conductive adapter for charging gun, the conductive adapter comprises a plastic holder 1, a sleeve 2 and a contact piece 3.

Figure 1:
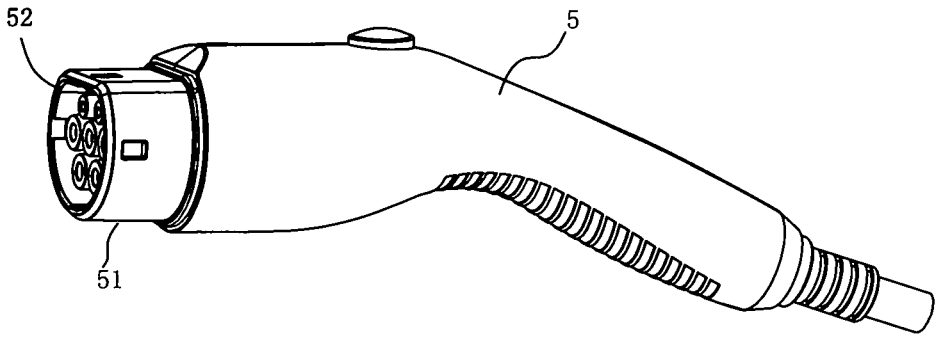
Fig. 1 (Prior Art)
FIG. 1 is a schematic view of an existing charging gun.
Figure 2:
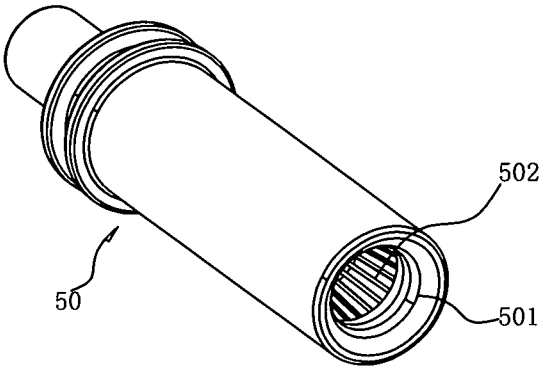
Fig. 2 (Prior Art)
FIG. 2 a perspective view of a conductive adapter of the existing charging gun
Figure 3:
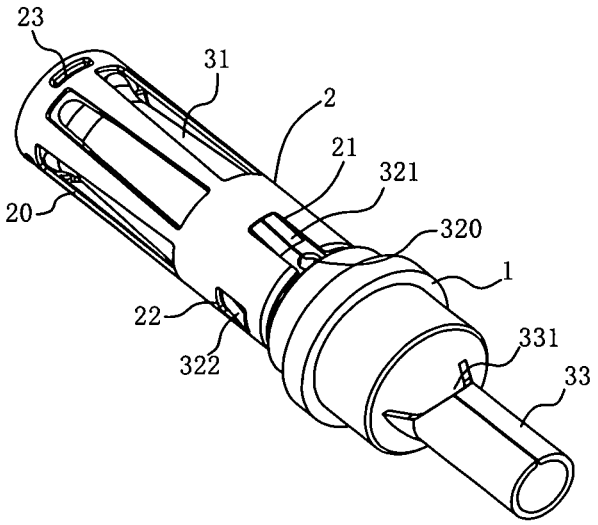
FIG. 3 is a perspective view of the present invention.
Figure 4:
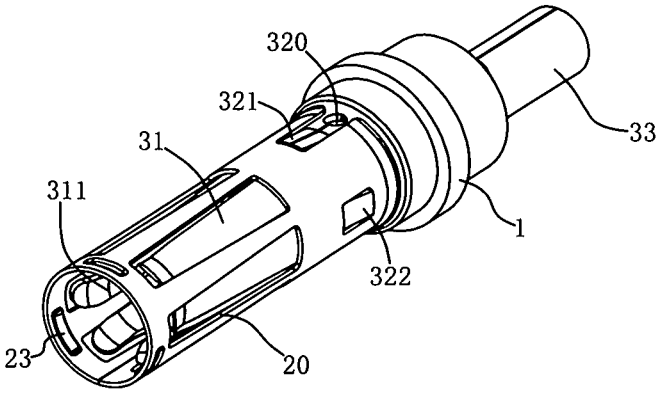
FIG. 4 is a perspective view of another aspect of the present invention.
Figure 5:
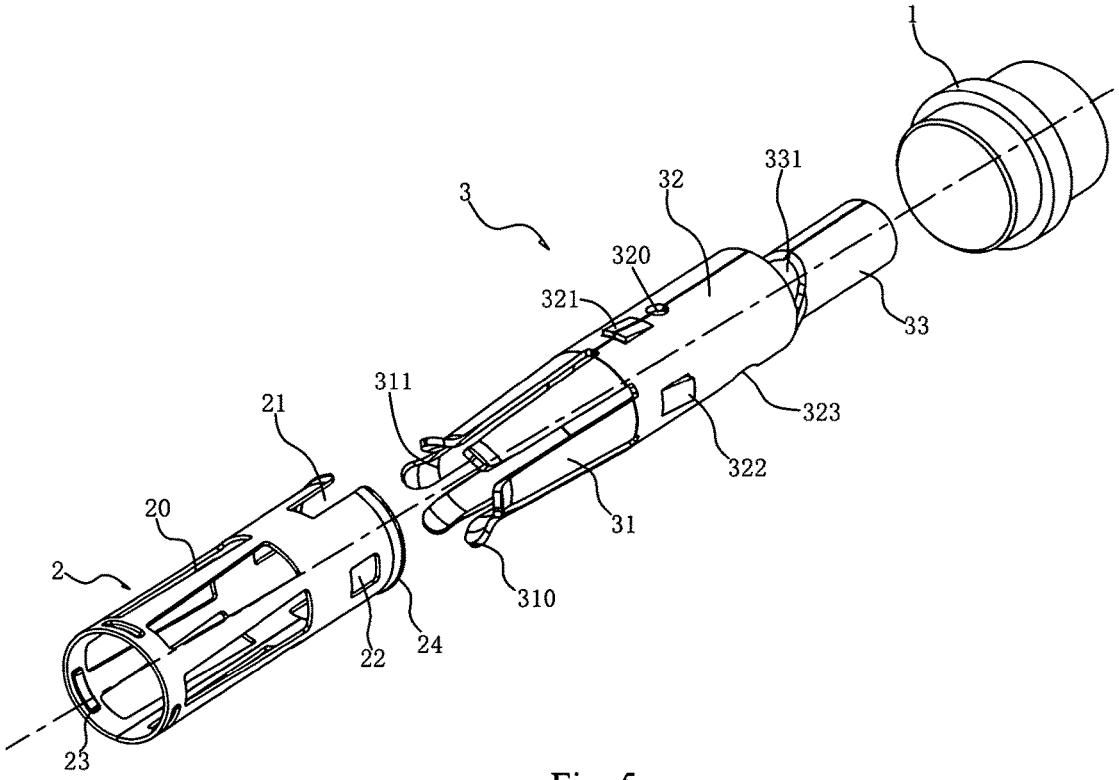
FIG. 5 is an exploded view of the present invention.
Figure 6:
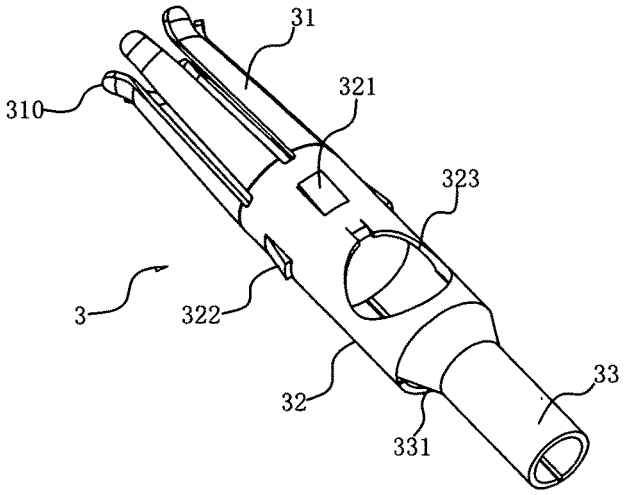
FIG. 6 is a perspective view of a contact piece of the present invention.

Said contact piece 3 is formed by punching a metal plate, and rolled by molding machine into the preset shape. As shown in FIGS. 5-6, the contact piece 3 is formed integrally and provided with multiple contact arms 31, connecting portion 32 and wiring portion 33. The number of contact arms 31 is set according to actual demand, generally as 4-8.

Said contact piece 3 is approximately rolled into a cylinder, namely, said connecting portion 32 is cylindrical, multiple contact arms 31 are extended forward from a periphery of one end of the connecting portion 32, the circumferential surface of said connecting portion 32 is integrated with front convex piece 321 and rear convex piece 322 bulging in opposite directions.

Said contact arm 31 extends forward from the connecting portion 32, the front end 310 of contact arm 31 turns outward, so that the front ends 310 of all contact arms 31 form a bell mouth shape, and bent inward near the front end 310 of contact arm 31 to form a bent bulge 311.

Said wiring portion 33 extends backward from connecting portion 32 to form a cylindrical shape, and there is a gap 331 in the junction of wiring portion 33 and connecting portion 32. The conductor end in power cord is fixed by wiring portion 33, so that the conductor in power cord and contact piece 3 form an electrical connection.

Said plastic holder 1 is fixed to said connecting portion 32 integrally, the wiring portion 33 extends from the back end of plastic holder 1. In order to further stabilize the connection between plastic holder 1 and contact piece 3, an injection molding hole 323 is drilled in the connecting portion 32 of contact piece 3. When the plastic holder 1 is formed on the contact piece 3 integrally, during the forming of plastic holder 1, the raw material enters the internal cavity of connecting portion 32 through the injection molding hole 323, so that the plastic holder 1 and contact piece 3 form a stable connection, preventing them from loosening even disconnecting in operation. The gap 331 formed in the junction of wiring portion 33 and connecting portion 32 has the same effect.

The plastic holder 1 is used for fixing the present invention, so the plastic holder 1 can be replaced directly by the plastic component of plug part in the charging gun, the contact piece 3 can be formed in the plastic component of charging gun plug integrally, the contact piece 3 is also fixed.

In addition, there is an air vent 320 in said connecting portion 32. The air vent 320 is located behind a front convex piece 321. The effect of air vent 320 is to enhance the flowability of electroplating solution when electroplating the contact piece 3. In addition, when the conductive contact pin (pole) is plugged into contact piece 3, the gas in the contact piece 3 can be discharged smoothly through the air vent 320, so that the conductive contact pin can be plugged in easily.

Said sleeve 2 is fitted over the tubular structure formed of contact arms 31, and there are hole slots 20 in the sleeve 2 corresponding to each contact arm 31. Said sleeve 2 and the contact piece 3 are buckled up, namely, there are groove 21 and locking hole 22 formed in said sleeve 2 corresponding to the front convex piece 321 and rear convex piece 322.

The shape of hole slot 20 in said sleeve 2 is larger than the projection of contact arm 31, so that the contact arm 31 extends and deforms into the hole slot 20 under internal extrusion.

In addition, there are multiple guide convex positions 23 formed uniformly near the inner edge of front end port on said sleeve 2. The effect of guide con vex position 23 is to prevent the conductive contact pin and the end of contact arm 31 from forming interference when the conductive contact pin is plugged into sleeve 2, the conductive contact pin is located in the center position of sleeve 2 with the support of guide convex position 23, so that the conductive contact pin can be plugged into the center position of cylindrical structure formed of contact arms 31 smoothly.

For convenient joint of sleeve 2 and contact piece 3, the back end port 24 of said sleeve 2 is flared, namely, the edge of back end port 24 turns outward slightly.

In the assembling of sleeve 2 and contact piece 3, the front end of contact arm 31 of contact piece 3 is put in the back end port 24 of sleeve 2 directly, and the groove 21 and locking hole 22 of sleeve 2 correspond to the front convex piece 321 and rear convex piece 322 on contact piece 3. When the specified depth is reached, the front convex piece 321 is plugged in along the groove 21 and forms interference with groove 21 eventually, so that the sleeve 2 cannot go deeper. Meanwhile the rear convex piece 322 falls in locking hole 22 exactly, and the sleeve 2 cannot be drawn out.

In the operation of the present invention, there are several conductive contact pins (poles) in the socket of the facility charged, when the charging gun of the present invention is plugged into the socket, the conductive contact pins are plugged into the present invention respectively. First, the conductive contact pins reach the center of tubular structure formed of contact arms 31 under the guidance of guide convex position 23, the side of conductive contact pin and the bent bulge 311 on contact arm 31 form interference, as the conductive contact pin goes in, it applies an outward force to the contact arm 31 via the bent bulge 311, the contact arm 31 bends and deforms outward under this pressure, the hole slot 20 in sleeve 2 gives the room for flexural deformation of contact arm 31. Due to the flexural deformation of contact arm 31, under the effect of elastic deformation force, the bent bulge 311 of contact arm 31 contacts the surface of conductive contact pin tightly, forming close electric contact.

It is observed that the present invention has a simple structure, the metalwork sleeve 2 and contact piece 3 can be formed by punching directly, in comparison to the existing production mode, the production cost of the present invention is reduced greatly, and automated job can be implemented, the production efficiency can be increased greatly. The present invention has low cost, good electric conduction stability and convenient production compared with the existing product.

Figure 7:
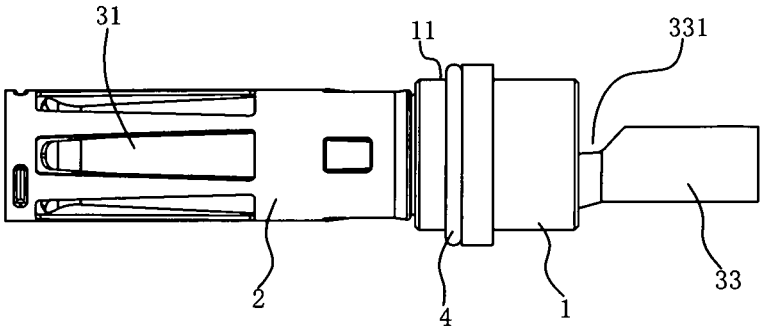
FIG. 7 is a front view of the present invention.
Figure 8:
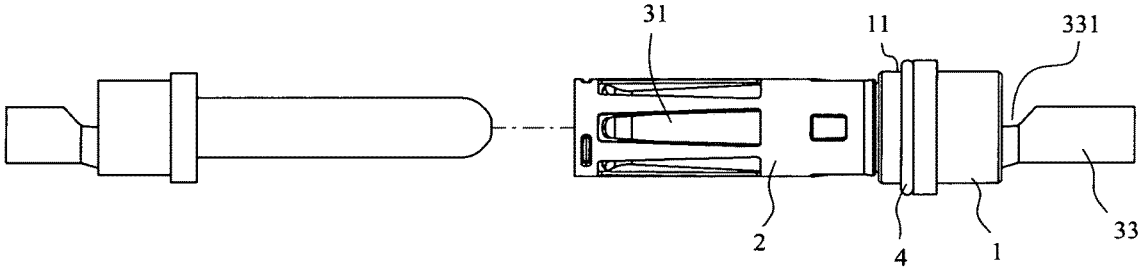
FIG. 8 is a perspective view showing an external receptacle with a conductive contact pin inserted into a sleeve.

In order to enhance the waterproof effect of the present invention, the present invention can be provided with a watertight structure, as shown in FIG. 7. The plastic holder 1 of the present invention is provided with an additional waterproof ring 4. The specific structure is described below, a stepped section 11 is formed on the side of said plastic holder 1 near sleeve 2, a waterproof ring 4 is fitted over the stepped section 11. In the design of additional waterproof ring 4, when the charging gun is assembled, the plug area and the wire connection area and circuit control area in the charging gun form a closed waterproof design, preventing the external liquid from entering the charging gun through the conductive adapter.

The above only describes some exemplary embodiments of the present invention. Those having ordinary skills in the art may also make many modifications and improvements without departing from the conception of the invention, which shall all fall within the protection scope of the invention.

I claim:

1. A charging connector for electric vehicle, comprising: a sleeve and a contact piece;

wherein the contact piece is a one-piece structure and integrally formed with a plurality of contact arms, a connecting portion and a wiring portion, the connecting portion is cylindrical and the plurality of contact arms are extended forward from a periphery of one end of the connecting portion;

wherein the sleeve is sleeved outside the contact arms and includes slots corresponding to each of the contact arms; the sleeve and the contact piece are connected by snaps;

when in use, a conductive contact pins in an external receptacle is inserted along a front end port disposed at a front end of the sleeve and inserted into the contact arms to form a conductive contact with the contact arms;

wherein the connecting portion is integrally formed with a front convex piece and a rear convex piece disposed on a circumferential surface thereof, the direction of the front convex piece and the rear convex are opposite to each other; the sleeve includes a groove and a locking hole respectively corresponding to the front convex piece and the rear convex piece;

wherein the connecting portion includes an air vent disposed thereon;

wherein a side of a plastic holder near the sleeve is formed with a stepped section on which a waterproof ring is fitted;

wherein the connecting portion of the contact piece is formed with an injection molding hole; when the plastic holder is integrally formed on the contact piece, raw material enters an internal cavity of the connecting portion through the injection molding hole, thereby forming a secure connection between the plastic holder and the contact piece.

2. The charging connector for electric vehicle according to claim 1, wherein the connecting portion of the contact piece is integrally formed with the plastic holder, and the wiring portion is protruded from a rear end of the plastic holder.

3. The charging connector for electric vehicle according to claim 2, wherein the wiring portion extending rearwardly from said connecting portion to form a cylindrical shape, and the wiring portion and connecting portion are formed with a gap disposed therebetween.

4. The charging connector for electric vehicle according to claim 1, wherein the contact arms extend forwardly from the connecting portion and front ends of the contact arm are turned outward so that the front ends of all the contact arms are formed as a bell mouth shape and bent inwardly at a position close to the front ends of the contact arms to form bent bulges.

5. The charging connector for electric vehicle according to claim 4, wherein an outer periphery of the slot formed in the sleeve is larger than a shape of the contact arm, so that the contact arm is internally pressed and deformed into the slot.

6. The charging connector for electric vehicle according to claim 1, wherein the sleeve includes a plurality of guide convex positions uniformly disposed near an inner edge of the front end port.

7. The charging connector for electric vehicle according to claim 1, wherein a back end port disposed at a rear end of the sleeve turns outward slightly at an edge thereof.

* * * * *